US007621965B2

(12) United States Patent
Motson

(10) Patent No.: US 7,621,965 B2
(45) Date of Patent: Nov. 24, 2009

(54) DRY CLEANING TEXTILES WITH A COMPOSITION CONTAINING ONE OR MORE ALCOHOL POLYOXYALKYLENE DERIVATIVES AND/OR ONE OR MORE BENZOATE OR PHENYL ALKYLCARBOXYLATE ESTERS

(75) Inventor: Harold R Motson, Cleveland (GB)

(73) Assignee: Croda International PLC, East Yorkshire (GB)

( * ) Notice: Subject to any disclaimer, the term of this patent is extended or adjusted under 35 U.S.C. 154(b) by 77 days.

(21) Appl. No.: 10/554,781

(22) PCT Filed: Apr. 26, 2004

(86) PCT No.: PCT/GB2004/001768

§ 371 (c)(1),
(2), (4) Date: Mar. 16, 2007

(87) PCT Pub. No.: WO2004/097103

PCT Pub. Date: Nov. 11, 2004

(65) Prior Publication Data

US 2007/0267045 A1 Nov. 22, 2007

(30) Foreign Application Priority Data

Apr. 29, 2003 (GB) ..... 0309755.7
Aug. 8, 2003 (GB) ..... 0318659.0
Aug. 8, 2003 (GB) ..... 0318698.8

(51) Int. Cl.
*D06L 1/02* (2006.01)
*D06L 1/08* (2006.01)

(52) U.S. Cl. ..... 8/142; 510/285; 510/289; 510/421; 510/488

(58) Field of Classification Search ..... 8/142; 510/285, 289, 421, 488
See application file for complete search history.

(56) References Cited

U.S. PATENT DOCUMENTS

| | | | | |
|---|---|---|---|---|
| 5,676,705 | A | 10/1997 | Jureller et al. | |
| 5,858,022 | A | 1/1999 | Romack et al. | |
| 6,148,645 | A | 11/2000 | DeYoung et al. | |
| 6,200,352 | B1 | 3/2001 | Romack et al. | |
| 6,258,766 | B1 * | 7/2001 | Romack et al. | 510/291 |
| 6,369,014 | B1 | 4/2002 | Murphy et al. | |
| 6,558,432 | B2 | 5/2003 | Schulte et al. | |
| 2004/0031107 | A1 | 2/2004 | Pegelow et al. | |

FOREIGN PATENT DOCUMENTS

| | | |
|---|---|---|
| FR | 2171978 | 9/1973 |
| JP | 09-143497 | 6/1997 |
| JP | 09-176684 | 7/1997 |
| JP | 2001-514337 | 9/2001 |
| JP | 2002-543951 | 12/2002 |
| WO | 9401227 | 1/1994 |
| WO | WO99/10585 | 3/1999 |
| WO | WO00/42249 | 7/2000 |
| WO | WO00/70141 | 11/2000 |
| WO | 0106053 | 1/2001 |
| WO | WO 01/06053 | * 1/2001 |
| WO | WO02/33039 | 4/2002 |

OTHER PUBLICATIONS

International Search Report for PCT/GB2004/001768 dated Oct. 28, 2004.

* cited by examiner

*Primary Examiner*—Brian P Mruk
(74) *Attorney, Agent, or Firm*—Jones Day

(57) ABSTRACT

Textiles are cleaned by first treating soiled areas of the textile with at least one pre-spotter material which is an alcohol polyoxyalkylene derivative or a benzoate ester. The textiles are subsequently dry cleaned in a medium based on liquid $C0_2$, typically also including a cleaning additive, particularly a multi-ester. The textile may also be treated with a fabric conditioner, particularly a fatty alcohol or fatty acid branched polyalkoxylate which may be included in the dry cleaning medium or in a subsequent rinse cycle.

29 Claims, No Drawings

DRY CLEANING TEXTILES WITH A COMPOSITION CONTAINING ONE OR MORE ALCOHOL POLYOXYALKYLENE DERIVATIVES AND/OR ONE OR MORE BENZOATE OR PHENYL ALKYLCARBOXYLATE ESTERS

CROSS REFERENCE TO RELATED APPLICATION

This application is the National Phase application of International Application No. PCT/GB2004/001768, filed Apr. 26, 2004, which designates the United States and was published in English. This application, in its entirety, is incorporated herein by reference.

This invention relates to cleaning textile materials and products including clothes using liquid carbon dioxide ($CO_2$) and cleaning additives and in particular to the use of pre-spotters to improve the cleaning performance of liquid $CO_2$ based dry cleaning systems.

The dry cleaning of clothes using fluid carbon dioxide, either as liquid or supercritical fluid, is known from many patents. An early suggestion is in U.S. Pat. No. 4,012,194 (Maffei) which teaches simply using liquid $CO_2$ as a substitute for halocarbon solvents e.g. perchlorethylene (perc), used in conventional dry cleaning. Later patents recognise that liquid $CO_2$ on its own is not particularly good at cleaning and develop approaches using detergent materials, including U.S. Pat. No. 5,676,705, U.S. Pat. No. 5,683,473, U.S. Pat. No. 5,683,977, U.S. Pat. No. 6,131,421, U.S. Pat. No. 6,148,644, and U.S. Pat. No. 6,299,652 assigned to Unilever and their equivalents, which relate to the use of defined surfactant detergents based on various classes of polymers and a series of cases, including U.S. Pat. Nos. 5,858,022, 6,200,352, 6,280,481, 6,297,206, 6,269,507 and International published application WO 01/06053, assigned to MiCell and their equivalents.

Another approach, which can be used in conjunction with surfactant detergents or other cleaning adjuncts involves pre-treating textiles with cleaning agents prior to dry cleaning. In particular, the cleaning agents are applied to parts of the textile that are specifically soiled. This technique is known as pre-spotting and is also used in conventional dry cleaning using perc, with pre-spotting materials appropriate to perc dry cleaning. U.S. Pat. No. 5,279,615 assigned to Chlorox Co uses cleaning non-polar organic cleaning adjuncts, especially alkanes, as pre-spotters in densified, particularly supercritical $CO_2$ dry cleaning systems.

Liquid $CO_2$ dry cleaning is relatively ineffective at removing hydrophilic soils such as coffee, wine, particularly red wine, and fruit juice stains from textiles and this invention addresses this problem by providing pre-spotter materials based on alcohol, particularly lower alcohol, polyethers (polyoxyalkylene derivatives) and a method of dry cleaning incorporating pre-spotting using such materials to improve the performance of liquid $CO_2$ based dry cleaning systems, particularly for such hydrophilic soils. We have found it possible to achieve significant improvement in the removal of such hydrophilic stains in liquid $CO_2$ based dry cleaning systems and a useful improvement in cleaning some hydrophobic or oily stains.

Liquid $CO_2$ dry cleaning is also only modestly effective in removing some hydrophobic or oily stains and this invention addresses this problem by providing pre-spotter materials based on benzoate or phenyl alkylcarboxylate esters and a method of dry cleaning incorporating pre-spotting using such materials to improve the performance of liquid $CO_2$ based dry cleaning systems, particularly for hydrophobic or oily soils. We have found it possible to achieve significant improvement in the removal of such hydrophobic or oily soils in liquid $CO_2$ based dry cleaning systems and a useful improvement in cleaning some hydrophilic soils.

The invention accordingly provides a method of dry cleaning which includes contacting textile material, particularly clothes, especially soiled areas of such textile material, with a pre-spotter which is at least one alcohol polyether and/or at least one benzoate or phenyl alkylcarboxylate ester and subsequently dry cleaning the textiles in a medium based on liquid $CO_2$.

In particular, the invention provides a method of dry cleaning which includes contacting textile material, particularly clothes, especially soiled areas of such textile material, with a pre-spotter material, particularly for hydrophilic or polar soils, especially soils such as coffee, wine, notably red wine, and fruit juice stains, including at least one alcohol polyoxyalkylene derivative, particularly a lower alcohol polyether, and subsequently dry cleaning the textiles in a medium based on liquid $CO_2$.

Further in particular, the invention provides a method of dry cleaning which includes contacting textile material, particularly clothes, especially soiled areas of such textile material, with a pre-spotter material including at least one benzoate or phenyl alkylcarboxylate ester, and subsequently dry cleaning the textiles in a medium based on liquid $CO_2$.

When used, the alcohol polyoxyalkylene derivatives (polyethers) used as pre-spotters in this invention are desirably of the formula (I):

$$R^1—(OA)_m\text{-}OR^2 \qquad (I)$$

where $R^1$ is a $C_1$ to $C_{10}$ hydrocarbyl, particularly alkyl, group;

$R^2$ is H or a $C_1$ to $C_4$ alkyl group;

OA is an oxyalkylene group, particularly an oxyethylene or oxypropylene group, and may vary along the (poly)oxyalkylene chain; and m is from 2 to 100, particularly 2 to 20.

$R^1$ is desirably an alkyl group and is usually a lower, particularly a $C_1$ to $C_8$, more particularly a $C_1$ to $C_6$, especially a $C_1$ to $C_4$, alkyl group, which is commonly a methyl group, although longer groups e.g. butyl or 2-ethylhexyl may also be used, and $R^2$ is desirably hydrogen.

In the polyoxyalkylene chain —$(OA)_m$-, the oxyalkylene group(s) can be oxyethylene (—$C_2H_4O$—), or oxypropylene (—$C_3H_6O$—), but desirably the oxyalkylene groups are all oxyethylene groups or are mixtures of oxyethylene and oxypropylene groups, desirably having a molar ratio of oxyethylene to oxypropylene groups of from 1:5 to 10:1, particularly 1:3 to 3:1. When the oxyalkylene groups are mixed oxyethylene and oxypropylene groups, the polyoxyalkylene chain can be a random (statistical) or block copolymeric chain. We have found that derivatives having a random polyoxyalkylene chain of mixed, and particularly random, oxyethylene and oxypropylene units at a molar ratio of 1:3 to 3:1 can be particularly useful as pre-spotters. Within the range 2 to 100 μm will commonly be from 2 to 50, more usually 2 to 20, particularly 2 to 10. The number of units in the (poly) oxyalkylene chain, 'm', is an average value and may be non-integral.

The alcohol polyether pre-spotters will often be used in conjunction with water as a solvent or carrier. The combination with water e.g. as an aqueous solution, may be a more effective pre-spotter material than the alkoxylate itself. When used the proportion of water to alcohol alkoxylate will typically be from 50:1 to 1:10 by weight e.g. by using a 5 to 75%, such as a 5 to 25%, particularly a 7 to 15%, or a 20 to 60% by weight aqueous solution of the alcohol alkoxylate. The concentration of the alkoxylate in the aqueous solution will be limited by the solubility of the alkoxylate in water and it is also desirable to use concentrations outside the gel region (if any) that the alkoxylate may have in aqueous systems.

When used, the benzoate and phenyl alkylcarboxylate esters used as pre-spotters in this invention are desirably of the formula (II):

$$(R^4)_p—Ph—(CH_2)_m—COO—R^3 \quad (II)$$

where $R^3$ is a $C_1$ to $C_{18}$ alkyl group, particularly a branched alkyl group, more usually a $C_5$ to $C_{12}$ alkyl group, more particularly a $C_5$ to $C_{10}$ branched alkyl group;

m is 0, 1 or 2, desirably 0; and

Ph is a phenyl group, which may be substituted with groups $(R^4)_p$; where each $R^4$ is independently a $C_1$ to $C_4$ alkyl or alkoxy group; and p is 0, 1 or 2, desirably 0.

Desirably in the compound of the formula (II) used in the invention $R^3$ is a branched alkyl group, particularly a $C_5$ to $C_{12}$ branched, such as a $C_5$ to $C_{10}$, alkyl group. For example $R^3$ can be an iso-amyl (3-methylbutyl), branched hexyl, branched octyl e.g. 2-ethylhexyl or "iso-octyl" (mixed mainly branched octyl) group, iso-nonyl or iso-stearyl (commercial iso-stearyl alcohol is a mixture of mainly branched alcohols), the branching reducing the ease with which the ester can be hydrolysed. Although the carboxylic acid used in the ester can be a dihydrocinnamic acid or a phenylacetic acid, it is desirably a benzoic acid i.e. with m=0, Similarly, although the phenyl ring of the acid may be substituted, it is desirable that it is unsubstituted i.e. with p=0. A particular esters of the formula (II) that can be used in this invention is 2-ethylhexyl benzoate.

Combinations of the above types of pre-spotters or of either or both of the above types of pre-spotter with other pre-spotters may be used. The pre-spotters may be combined by sequentially application as pre-spotters or by using a formulation including two or more pre-spotters. The use of combinations including both at least one alcohol polyoxyalkylene derivative and at least one benzoate or phenyl alkylcarboxylate ester can be particularly beneficial in removing hydrophobic or oily soils from textiles as it seems that the benzoate or phenyl alkylcarboxylate ester can soften or loosen the soil on the textile and the alcohol polyoxyalkylene derivative can aid dispersal of the soil and its removal from the textile.

Other ingredients that can be included in pre-spotter formulations include surfactant detergent materials, dispersants and anti-redeposition agents, fragrances and bleaches, particularly peroxide bleaches e.g. organic and/or inorganic peroxides or hydrogen peroxide or a source of hydrogen peroxide. The pre-spotter may be formulated as a liquid, or as a spreadable gel or solid. Other formulation components, such as solvents e.g. water as can be used with the alcohol alkoxylates as described above, and carriers may be included to achieve a particular desired physical form for the pre-spotter formulation in particular water can be used as a carrier with benzoate or phenyl alkylcarboxylate esters to formulate them as aqueous emulsions, desirably aqueous micro-emulsions. In this approach, typically, to form a microemulsion a combination of a non-ionic surfactant e.g. an alcohol alkoxylate, and an anionic surfactant e.g. a sulphosuccinate, will be used to microemulsify the ester in the water.

The amount of the pre-spotter or pre-spotter formulation used will generally be enough to treat and usually to wet the textile being treated. The area of the textile treated will generally include all the soiled area which it is desired to treat by pre-spotting. The soiled area of the textile will usually be treated by spreading e.g. by brushing, spotting or spraying the pre-spotter, depending on the physical form of the formulation, onto and over the soiled area. The soiled area may then be rubbed, brushed or scrubbed to encourage good contact between the pre-spotter and the soil and to aid removal of the soil from the textile. The pre-spotted textile is subsequently dry cleaned in a medium based on liquid $CO_2$.

In the cleaning of the textile materials, after pre-spotting, using liquid $CO_2$ based dry cleaning systems, the liquid $CO_2$ will usually include one or more cleaning additives i.e. material added to the liquid $CO_2$ to improve its cleaning performance. In describing the medium as "based on liquid $CO_2$" we mean that the medium is liquid $CO_2$ which may include cleaning and other additives. Cleaning additives may be surfactant detergent materials or, and particularly, non-surfactant cleaning additives. Examples of non-surfactant cleaning additives in liquid $CO_2$ based dry cleaning systems include multi-esters.

Multi-esters are compounds having 2 or more carboxylic acid ester groups. The invention accordingly includes a method of dry cleaning which includes contacting textile material, particularly clothes, especially soiled areas of such textile material, with a pre-spotter material, particularly for hydrophilic or polar soils, especially soils such as coffee, wine, notably red wine, and fruit juice stains, which is or includes is at least one alcohol polyoxyalkylene derivative and subsequently dry cleaning the textiles in a medium based on liquid $CO_2$ and additionally including at least one multi-ester. The invention further includes a method of dry cleaning which includes contacting textile material, particularly clothes, especially soiled areas of such textile material, with a pre-spotter material including at least one benzoate or phenyl alkylcarboxylate ester, and subsequently dry cleaning the textiles in a medium based on liquid $CO_2$ and additionally including at least one multi-ester.

When used such multi-esters are desirably of the formula (III):

$$R^5(—C(O)O—R^6)_n \quad (III)$$

where $R^5$ is a direct bond or the residue of a $C_1$ to $C_{10}$ hydrocarbyl group from which n hydrogen atoms have been removed; and $R^6$ is a hydrocarbyl group, particularly a $C_1$ to $C_{30}$ hydrocarbyl group n is from 2 to 5.

Among compounds of the formula (III), the group $R^5$ is desirably $—(CH^2)_m—$ where m=2 to 6, particularly 2 to 4, and thus the corresponding esters include di-esters of dicarboxylic acids such as succinic, glutaric and adipic acids, for example as in mixed esters of succinic, glutaric and adipic acids.

The group $R^6$ is desirably an alkyl group and may be a short chain alkyl group for example methyl, ethyl or propyl, particularly methyl, or can be a longer chain hydrocarbyl group particularly a $C_6$ to $C_{24}$ hydrocarbyl, particularly alkyl, group for example a 2-ethyl hexyl or a decyl (straight chain or branched) group.

The use of such longer chain hydrocarbyl esters can give advantages in terms of reducing the tendency of the cleaning additive to adversely affect certain fabric polymers particularly polyacetate. Accordingly, the invention includes a method of dry cleaning which includes contacting textile material, particularly clothes, especially soiled areas of such textile material, with a pre-spotter material, particularly for hydrophilic or polar soils, especially soils such as coffee, wine, notably red wine, and fruit juice stains, including at least one alcohol polyoxyalkylene derivative, and subsequently dry cleaning the clothes by contacting the textile material, with a dry cleaning medium based on liquid $CO_2$ and including from 0.01 to 5% by weight of the cleaning medium of a cleaning additive which is at least one $C_6$ to $C_{24}$ hydrocarbyl ester of a multi-carboxylic acid. Particularly useful such esters include di-2-ethyl hexyl adipate, di-decyl adipate and di-iso-decyl adipate.

The molecular weight of the multi-ester cleaning additive (average molecular weight if the additive is a mixture of compounds) is generally within the range about 150 to 1000, more usually from 150 to 300 or from 250 to 800, desirably from 300 to 750, and particularly from 350 to 700. Thus, molecular weights for individual components of the formula (III) can be for example 146 for dimethyl succinate, 160 for dimethyl glutarate, 174 for dimethyl adipate, from about 150 to 170 for mixed dimethyl esters of succinic, glutaric and adipic acids e.g. for an approximately 1:1:3 mixture the average molecular weight is about 165, 370 for dioctyl or di-(2-ethylhexyl)adipate, 426 for di-decyl or di-isodecyl adipate, 510 for di-tridecyl or di-iso-tridecyl adipate, 650 for di-stearyl adipate (straight or branched chain stearyl) and about 650 for di-iso-stearyl adipate (bearing in mind that commercial "iso-stearyl" alcohol is a mixture of alcohols of different chain length averaging about C18).

When present, the amount of the multi-ester used will typically be from 0.01 to 5%, usually from 0.05 to 2%, more usually from 0.1 to 1%, particularly from 0.1 to 0.5% and more particularly from 0.1 to 0.3% by weight of the cleaning medium. The use of lower amounts of cleaning additive will not generally give useful results and use of larger amounts does not appear to give additional benefits and may result in including so much additive in the system that additive residues are deposited onto the textiles being cleaned or left on the walls of the cleaning apparatus.

Other ingredients can be included in the dry cleaning formulation such as fragrances, optical brighteners, fabric conditioners such as softeners, and sizes e.g. starch, enzymes, anti-redeposition agents, bleaches, particularly peroxide bleaches e.g. organic and/or inorganic peroxides or hydrogen peroxide or a source of hydrogen peroxide.

Fabric conditioners or softeners that can be used in the invention include fatty branched poly-alkoxylates, particularly fatty alcohol, branched polyalkoxylates, especially propoxylates. We have found that such materials can give improved softness and handling characteristics to textiles, particularly clothes, after treatment. In this context, the term "branched polyalkyloxylate" refers to polyalkoxylate chains including a substantial proportion of units which have side chains e.g. as provided by propyleneoxy or butyleneoxy units. The term "fatty branched polyalkyloxylate" refers collectively to branched polyalkyloxylate based on fatty alcohols or fatty acids. The use of fatty branched polyalkoxylates as such conditioning or softening agents is described in our copending PCT application PCT/GB 02/03828 (published as WO 04/018764 A).

When used the amount of the conditioning agent, particularly alcohol branched polyalkyloxylate, present in the cleaning medium is from 0.001 to 2.5%, usually from 0.005 to 2%, more usually from 0.01 to 1%, particularly from 0.01 to 0.1% and more particularly from 0.01 to 0.5% by weight of the cleaning medium. The use of lower amounts of conditioning agent will not generally give useful results and use of larger amounts does not appear to give additional benefits and may result in including so much conditioning agent in the system that conditioning agent residues are deposited onto the textiles being cleaned or left on the walls of the cleaning apparatus.

The invention accordingly includes a method of method of dry cleaning which includes contacting textile material, particularly clothes, especially soiled areas of such textile material, with a pre-spotter material which is or includes one or more alcohol polyoxyalkylene derivatives and/or one or more, benzoate or phenyl alkylcarboxylate esters and subsequently dry cleaning the textiles in a medium based on liquid $CO_2$.

The invention further includes a method of dry cleaning which includes contacting textile material with a pre-spotter material which is or includes one or more alcohol polyoxyalkylene derivatives and/or one or more, benzoate or phenyl alkylcarboxylate esters and subsequently dry cleaning the textiles in a medium based on liquid $CO_2$, which may include a cleaning additive such as a multi-ester, and which includes at least one alcohol branched polyalkyloxylate fabric conditioner.

The invention further includes a method of method of dry cleaning which includes contacting textile material, particularly clothes, especially soiled areas of such textile material with a pre-spotter The Birthday Party material including at least one benzoate or phenyl alkylcarboxylate ester, and subsequently dry cleaning the textiles in a medium based on liquid $CO_2$, which may include a cleaning additive such as a multi-ester, and which includes at least one alcohol branched polyalkyloxylate fabric conditioner.

The textiles to be cleaned will usually be garments and can be of woven or non-woven fabrics. The fibre making up the fabric can be or include a wide range of natural and synthetic fibres including polyamides particularly natural polyamides such as silk and wool and synthetic polyamides such as nylon, cellulosic fibres such as cotton, linen and rayon, synthetic polymers such as polyester, particularly polyethylene terephthalate or related copolymers, or acetate polymers.

The particular mode of operation will depend on the equipment used. Generally the cleaning will be carried out in a drum, which may have its axis vertical or horizontal. The textiles are introduced into the drum which is then sealed and filled with the cleaning medium including carbon dioxide typically to give a mixture of liquid and gaseous $CO_2$ in the drum. The textiles and liquid $CO_2$ based cleaning medium are then agitated to give thorough mixing and contact between the cleaning medium and textiles. The textiles will be contacted with the cleaning medium for a time adequate to clean the textiles to the desired extent. The cleaning medium is then separated from the textiles, typically by draining or venting it from the drum. Generally the textiles will be subject to one such cleaning cycle, but if desired the cleaning cycle may be repeated to obtain a higher degree of cleaning. Usually, the textiles are subject to at least one rinse cycle with liquid carbon dioxide usually not including cleaning additives, but which may include fabric softeners, optical bleaches etc if desired. The rinse liquid is similarly separated from the textiles, which can then recovered by de-pressurising the drum and opening it to removed the textiles.

Fabric conditioners that can be included in the rinse cycle include the fatty branched polyalkyloxylate mentioned above typically used. The invention accordingly includes a method of dry cleaning which includes contacting textile material, particularly clothes, especially soiled areas of such textile material, with a pre-spotter material which is or includes one or more alcohol polyoxyalkylene derivatives and/or one or more, benzoate or phenyl alkylcarboxylate esters and subsequently dry cleaning the textiles in a medium based on liquid $CO_2$, usually additionally including at least one cleaning additive such as a multi-ester, followed by a conditioning step in which textile material, particularly clothes, is contacted with a treatment medium based on liquid $CO_2$ and which includes a conditioning agent which is or includes at least one fatty alcohol or fatty acid branched polyalkyloxylate.

The invention further includes a method of dry cleaning which includes contacting textile material, particularly clothes, especially soiled areas of such textile material, with a pre-spotter material which is or includes one or more alcohol polyoxyalkylene derivatives and subsequently dry cleaning the textiles in a medium based on liquid $CO_2$, usually additionally including at least one cleaning additive such as a multi-ester, followed by a conditioning step in which textile material, particularly clothes, is contacted with a treatment medium based on liquid $CO_2$ and which includes a conditioning agent which is or includes at least one fatty alcohol or fatty acid branched polyalkyloxylate.

The invention further includes a method of dry cleaning which includes contacting textile material, particularly clothes, especially soiled areas of such textile material, with a pre-spotter material which is or includes one or more, benzoate or phenyl alkylcarboxylate esters and subsequently dry cleaning the textiles in a medium based on liquid $CO_2$, usually additionally including at least one cleaning additive such as a multi-ester, followed by a conditioning step in which textile material, particularly clothes, is contacted with a treatment medium based on liquid $CO_2$ and which includes a conditioning agent which is or includes at least one fatty alcohol or fatty acid branched polyalkyloxylate.

Any suitable apparatus for dry cleaning with liquid carbon dioxide can be used. Typically such apparatus includes a drum in which the cleaning is carried out. The drum may have its axis horizontal or vertical. (Other angles of orientation will generally be less convenient in operation.) Providing agitation in a horizontal axis drum can simply be by rotation around its axis. Vertical axis drums will usually include an agitator which can be moved to agitate the drum contents. Other means of agitation include paddles or vanes in the drum or by jetting liquid $CO_2$ into the mixture of cleaning medium and textiles in the drum. Suitably vigorous agitation may give rise to cavitation in the cleaning medium and this may improve the cleaning performance.

Typically the cleaning temperature will be from −10 to 25° C., more usually from 5 to 25° C., particularly from 10 to 20° C. The operating temperature will not usually be above about 25° C. to maintain the cleaning medium a reasonable margin from the critical point of $CO_2$, as supercritical $CO_2$ may extract textile dyes from fabrics. Operating at or near ambient temperature simplifies operation of the process, but using a lower temperature means that the $CO_2$ is more dense and a more effective cleaning agent. Temperatures in the range 10 to 17° C., particularly 12 to 15° C. generally provide a reasonable balance of properties and are thus advantageous.

During cleaning the cleaning medium must be kept at a pressure which maintains the $CO_2$ at least partially as a liquid. This will usually be the vapour pressure of the cleaning medium at the temperature of operation because, as is noted above, it is desirable for both liquid and gaseous $CO_2$ to be present. At the typical operating temperatures noted above, the corresponding pressures are approximately 2.7 to 6.4 MPa, more usually from 4 to 6.4 MPa, particularly from 4.5 to 5.7 MPa and balancing density and temperature 4.5 to 5.5 MPa, particularly from 4.9 to 5.1 MPa.

The invention is illustrated by the following Examples. All parts and percentages are by weight unless otherwise indicated.

Materials

PS1 10% by weight aqueous solution of butane diol polyoxypropylene polyoxyethylene (Atlas G 5000 ex Uniqema)

PS2 50% by weight aqueous solution of polyalkyleneoxy butanol (random EO/PO chain ca. 9 units in total MW ca 500)

PS3 2-ethylhexyl benzoate

Cleaning testing used standard "Krefeld" stained cloths. The codes for these cloths include a number indicating the fabric type and a letter or letters indicating the soil as follows:

| Cloth Type | | | Soil Type | | |
|---|---|---|---|---|---|
| 10 | cotton | C | WFK soil*/lanolin mix | GM | used motor oil |
| 30 | polyester (PET) | D | Pigment/sebum | K | coffee |
| 90 | cotton | Li | Red wine | | |

*WFK soil - a mixed soil based on kaolinite and containing soot and iron oxide pigments Cleaning effectiveness—was assessed spectrometrically (using an X-Rite Spectrophotomeric Colour Measurement system) by comparison of commercially available standard soiled cloths before and after cleaning with the results given as % stain removal.

Test Methods

The effectiveness of compounds as pre-spotters was investigated by one of the following methods.

Test Method 1

Test cloths 5 cm square were attached to a test sheet of clean white cotton, or polycotton. 2-3 drops of the test pre-spotter were applied to the centre of each test cloth, sufficient to cover an area about 2.5 cm diameter. One pre-spotter was tested per test sheet. The test sheets with the pre-spotted cloths attached were then placed in a Electrolux Wascator dry cleaning machine with 4.5 kg of mixed garments as ballast and then subjected to a standard 10 minute was cycle with 0.1% of CA1 as cleaning additive.

After the wash cycle the test cloths were recovered and the effectiveness of the pre-spotter measured by noting the difference in reflectance of pre-spotted and non pre-spotted areas using an X-Rite Spectrophotomeric Colour Measurement system—the larger the difference the greater the improvement given by pre-spotting.

Test Method 2

Test cloths 5 cm square were attached to a sheet of clean white cotton, or polycotton. Pre-spotters were applied to the test swatch by spraying from a pump action spray until the surface of the swatch was completely wetted and an area of the surface was brushed 20 times in the same direction using a small nail brush.

The sheets with the pre-spotted swatches attached were then placed in a Electrolux Wascator dry cleaning machine with 4.5 kg of mixed garments as ballast. They were then subjected to a standard 10 minute was cycle with 0.1% of CA1 as cleaning additive.

After the wash cycle the pre-spotted test cloths were recovered and the effectiveness of the pre spotter measured by noting the difference in reflectance of pre-spotted and non-pre-spotted areas using an X-Rite Spectrophotomeric Colour Measurement system and by visually assessing the test swatch. The test results were ranked on a numerical scale from 0=no observed improvement in cleaning to 6=substantial improvement in cleaning.

EXAMPLE 1

A range of pre-spotters was tested using test method 1 above for effectiveness in cleaning a variety of soils. The materials used and the results obtained are summarised in table 1 below.

TABLE 1

| Pre-Spotter | 30C | 30D | 10GM | 10K |
|---|---|---|---|---|
| PS1 | 6 | 6 | 5 | 6 |
| PS3 | 13.2 | — | 20.7 | 7.6 |

EXAMPLE 2

A range of pre-spotters was tested using test method 2 above for effectiveness in cleaning a variety of soils. The materials used and the results obtained are summarised in table 2 below.

TABLE 2

| Pre-Spotter | 30C | 30D | 10GM | 10K |
|---|---|---|---|---|
| PS3 | 6 | 6 | 5 | 1 |

EXAMPLE 3

Pre-spotters PS1 and PS2 were tested using Test Method 2 above for effectiveness in cleaning a variety of soils, with water as a control. The materials used and the results obtained are summarised in Table 3 below.

TABLE 3

| Ex No | Pre-Spotter | 30C | 90Li | Notes |
|---|---|---|---|---|
| 2.C | Water | 4 | 2 | ring left on cloth* |
| 2.1 | PS1 | 6 | 6 | ring left on cloth* |
| 2.2 | PS2 | 7 | 7 | no ring on cloth** |

*darker residual ring left on test cloth where material forming the stain was washed away from centre of addition of the pre-spotter.
**slightly paler colour in stained cloth after washing, but shows no residual ring.

The invention claimed is:

1. A method of dry cleaning, comprising:

i) contacting a textile material with a pre-spotter material, comprising:

(a) one or more alcohol polyoxyalkylene derivatives of formula (I):

$$R^1—(OA)_m—OR^2 \quad (I)$$

where $R^1$ is a $C_1$ to $C_6$ alkyl group;

$R^2$ is H or a $C_1$ to $C_4$ alkyl group;

OA is a random copolymeric chain of oxyethylene and oxypropylene groups; and m is from 2 to 50; and/or (b) one or more benzoate esters or phenyl alkylcarboxylate esters; and ii) subsequently dry cleaning the textiles in a medium based on liquid $CO_2$.

2. The method of claim 1, wherein $R^2$ is hydrogen.

3. The method of claim 1, wherein the molar ratio of oxyethylene to oxypropylene groups of from 1:5 to 10:1 and m is from 2 to 20.

4. The method of claim 3, wherein the random copolymeric chain has a molar ratio of from 1:3 to 3:1.

5. The method of claim 1, wherein the alcohol polyoxyalkylene derivative is present as a solution or mixture with water.

6. The method of claim 5, wherein the proportion of water to alcohol alkoxylate is from 50:1 to 1:10 by weight.

7. The method of claim 5, wherein the alcohol polyoxyalkylene derivative is present as an aqueous solution at a concentration of from 5 to 75% by weight.

8. The method of claim 1, wherein the benzoate ester or phenyl alkylcarboxylate ester is one or more compounds of the formula (II):

$$(R^4)_p\text{-Ph-}(CH_2)_m—COO—R^3 \quad (II)$$

where $R^3$ is a $C_1$ to $C_{18}$ alkyl group;

m is 0, 1 or 2;

Ph is a phenyl group $R^4$ is independently a $C_1$ to $C_4$ alkyl or alkoxy group; and p is 0, 1 or 2.

9. The method of claim 8, wherein the benzoate ester is 2-ethylhexyl benzoate.

10. The method of claim 8, wherein the benzoate ester is present as an emulsion or microemulsion in water.

11. The method of claim 10 wherein the benzoate ester is present as an aqueous microemulsion and the microemulsion includes a non-ionic surfactant and an anionic surfactant.

12. The method of claim 1, wherein in the medium based on liquid $CO_2$ includes one or more cleaning additives which is a multi-ester.

13. The method of claim 12, wherein the multi-ester is a compound of the formula (III):

$$R^5(—C(O)O—R^6)_n \quad (III)$$

where $R^5$ is a direct bond or the residue of a $C_1$ to $C_{10}$ hydrocarbyl group from which n hydrogen atoms have been removed;

$R^6$ is a hydrocarbyl group; and n is from 2 to 5.

14. The method of claim 13, wherein group $R^6$ is a $C_1$ to $C_{30}$ hydrocarbyl group.

15. The method of claim 13, wherein the multi-ester is a di-ester of one or more of succinic, glutaric and adipic acids.

16. The method of claim 13, wherein the multi-ester is a methyl, ethyl or propyl ester.

17. The method of claim 16, wherein the multi-ester is a mixture of the di-methyl esters of succinic, glutaric and adipic acids.

18. The method of claim 13, wherein the multi-ester is a $C_6$ to $C_{24}$ hydrocarbyl ester.

19. The method of claim 13, wherein the multi-ester is an adipate ester.

20. The method of claim 13, wherein the multi-ester is, di-(2-ethylhexyl) adipate, di-decyl adipate or di-iso-decyl adipate.

21. The method of claim 1, wherein the medium based on liquid $CO_2$ includes one or more fatty alcohol polyalkoxylate or fatty acid polyalkoxylate fabric conditioners.

22. The method of claim 12, wherein the medium based on liquid $CO_2$ includes one or more fatty alcohol polyalkoxylate or fatty acid polyalkoxylate fabric conditioners.

23. The method of claim 22, wherein the fatty alcohol polyalkoxylate is a fatty alcohol polypropoxylate.

24. The method of claim 11, wherein the non-ionic surfactant is an alcohol alkoxylate, and the anionic surfactant is a sulphosuccinate.

25. The method of claim 13, wherein group $R^5$ is $—(CH_2)_m—$ where m =2 to 6.

26. The method of claim 1, further comprising rinsing the dry cleaned textiles with a rinse medium based on liquid $CO_2$.

27. The method of claim 26, wherein the rinse medium includes one or more fatty alcohol polyalkoxylate or fatty acid polyalkoxylate fabric conditioners.

28. The method of claim 27, wherein at least one of the fabric conditioners is a fatty alcohol polypropoxylate.

29. The method of claim 21, wherein at least one of the fabric conditioners is a fatty alcohol polypropoxylate.

* * * * *